US006974406B2

(12) United States Patent
Antonacci

(10) Patent No.: US 6,974,406 B2
(45) Date of Patent: Dec. 13, 2005

(54) SIDE-SEALED BAG HAVING LABEL SECTION AND METHOD OF PRODUCTION THEREFOR

(76) Inventor: Paul Antonacci, 3061 Vinings Ridge Dr., Atlanta, GA (US) 30339

( * ) Notice: Subject to any disclaimer, the term of this patent is extended or adjusted under 35 U.S.C. 154(b) by 0 days.

(21) Appl. No.: 10/037,347

(22) Filed: Oct. 23, 2001

(65) Prior Publication Data

US 2002/0102033 A1 Aug. 1, 2002

Related U.S. Application Data

(63) Continuation-in-part of application No. 09/158,307, filed on Sep. 22, 1998, now Pat. No. 6,371,645.

(51) Int. Cl.[7] ..... B31B 1/64
(52) U.S. Cl. ..... 493/189; 186/243
(58) Field of Search ..... 493/192, 196, 493/189, 191, 231, 243, 186; 393/117, 107, 393/109; 428/190, 191, 174; 53/455

(56) References Cited

U.S. PATENT DOCUMENTS

| | | | | |
|---|---|---|---|---|
| 1,725,864 A | | 8/1929 | James | |
| 1,822,948 A | | 9/1931 | Armstrong | |
| 1,872,640 A | | 8/1932 | Pink | |
| 1,942,086 A | | 1/1934 | Cheatham | |
| 2,085,365 A | | 6/1937 | Israel | |
| 2,143,844 A | * | 1/1939 | Daller | 428/191 |
| 2,416,747 A | | 3/1947 | Geimer | |
| 2,428,266 A | * | 9/1947 | Daniels | 383/102 |
| 2,565,754 A | | 8/1951 | Brady et al. | |
| 2,774,402 A | * | 12/1956 | Wikle | 383/102 |
| 2,916,197 A | * | 12/1959 | Detrie et al. | 206/219 |
| 3,123,279 A | | 3/1964 | Day | |
| 3,209,983 A | * | 10/1965 | Bellezanne | 383/113 |
| 3,249,286 A | | 5/1966 | Palmer | |
| 3,257,915 A | | 6/1966 | Cartier et al. | |
| 3,279,511 A | | 10/1966 | Griffin, Jr. | |
| 3,338,019 A | * | 8/1967 | Trewella et al. | 53/412 |
| 3,411,419 A | * | 11/1968 | Becker et al. | 493/192 |
| 3,470,928 A | | 10/1969 | Schwartz | |
| 3,554,368 A | | 1/1971 | Nagel | |
| 3,630,798 A | * | 12/1971 | Wicks | 493/188 |
| 3,871,910 A | | 3/1975 | Barkis et al. | |
| 3,970,503 A | | 7/1976 | Yoshimura | |
| 4,010,785 A | | 3/1977 | Patik | |
| 4,091,595 A | | 5/1978 | Pelster et al. | |
| 4,196,534 A | | 4/1980 | Shibamoto | |
| 4,207,983 A | | 6/1980 | Wolske | |
| 4,403,637 A | | 9/1983 | Rivelles Sabater et al. | |

(Continued)

FOREIGN PATENT DOCUMENTS

DE 26 36 821 A1 2/1978

(Continued)

*Primary Examiner*—Eugene Kim
*Assistant Examiner*—Paul Durand
(74) *Attorney, Agent, or Firm*—Ashish D. Patel, Esq.; Joel D. Myers, Esq.; Myers & Kaplan, LLC

(57) ABSTRACT

The present invention provides an improved side-sealed bag comprising an open, mesh-like fabric and a label section. The bag has a closed end formed by a fold in the fabric, an opposing end and longitudinal, heat-sealed side seams extending from the closed end to the opposing end. The bags are used for packaging articles for which visibility and/or breathability of the bag fabric are useful characteristics. In a preferred embodiment, the bags are also suited for manufacture and filling using high speed, automated equipment.

45 Claims, 7 Drawing Sheets

U.S. PATENT DOCUMENTS 4,557,958 A 12/1985 Barkis et al.
4,681,781 A 7/1987 Murray et al.
4,758,297 A 7/1988 Calligarich
4,801,081 A 1/1989 O'Connor
4,883,695 A * 11/1989 Weimar ..... 428/35.2
4,929,303 A 5/1990 Sheth
4,949,842 A 8/1990 Mokiao, II
5,077,001 A * 12/1991 Makowka ..... 383/5
5,135,313 A * 8/1992 Bowman ..... 383/5
5,182,162 A 1/1993 Andrusko
5,244,724 A 9/1993 Antonacci et al.
5,300,345 A 4/1994 Aihara et al.
5,385,766 A * 1/1995 Ferre ..... 428/36.1
5,584,580 A * 12/1996 Vetter ..... 383/5
5,631,068 A * 5/1997 Smith ..... 428/195
5,730,530 A 3/1998 Stoddard et al.
5,788,377 A * 8/1998 Vetter ..... 383/5
5,823,683 A 10/1998 Antonacci et al.
5,912,197 A * 6/1999 Madderom ..... 442/305
6,005,234 A * 12/1999 Moseley et al. ..... 219/727
6,015,235 A 1/2000 Kraimer et al.
6,015,373 A 1/2000 Henderson et al.
6,024,489 A 2/2000 Fox et al.
6,030,120 A 2/2000 Fox et al.
6,080,093 A 6/2000 Henderson et al.
6,114,024 A 9/2000 Forte
6,185,908 B1 2/2001 Madderom
6,186,662 B1 2/2001 Jackson
6,190,044 B1 2/2001 Fox et al.
6,233,905 B1 * 5/2001 Singh ..... 53/381.1

FOREIGN PATENT DOCUMENTS

EP 0 677 450 A1 10/1995
EP 0 788 974 A2 8/1997
FR 2 584 651 1/1987
JP 2-45359 A 2/1990

* cited by examiner

SIDE-SEALED BAG HAVING LABEL SECTION AND METHOD OF PRODUCTION THEREFOR

PRIORITY CLAIM

This is a continuation in part of application Ser. No. 09/158,307 now U.S. Pat. No. 6,371,645, entitled "Open Mesh Bag", filed Sep. 22, 1998, and hereby claims priority to and full benefit thereof, the disclosure of which is incorporated herein in its entirety.

TECHNICAL FIELD

The present invention relates generally to bags, and more specifically to a side-sealed bag having a label section and method of production therefor. The present invention is particularly suitable for, although not limited to, packaging goods and articles.

BACKGROUND OF THE INVENTION

Heretofore, mesh bags have been used for various packaging applications including those in which breathability and visibility of the bags' contents are important features. Examples include produce bags for fruits, vegetables and other agricultural products and bags for sporting equipment, toys, blocks and various other small to medium size solid objects. Such bags have been made from solid plastic films, tubular packaging materials, such as VEXAR originated by E. I. du Pont de Nemours and Company, leno weave fabrics, knitted fabrics and flat woven fabrics, all of which are disadvantageous. For example, tubular materials require investment in specialty equipment to prepare bags from same (see, e.g., U.S. Pat. No. 4,091,595). Flat weave and knitted packaging materials, while avoiding complexities associated with tubular goods, are disadvantageous because they are typically sewn to form seams, thus adding to cost. Nonwoven fabrics seldom achieve a practical balance of strength and contents-visibility and they are often difficult to seam with appropriate strength. Plastic films lack breathability; attempts to overcome this limitation, such as by perforation, add cost, can impair strength and generally do not perform satisfactorily.

Beyond traditional attributes of produce bags, including strength, breathability and sufficient transparency or openness to allow viewing of their contents, high speed and automated bag-making and filling equipment have imposed additional requirements. To process well on high-speed bag-making equipment, bag substrates must track precisely through the equipment and remain in registration over the entire sequence of bag-making steps. The substrate must remain precisely in registration through repeated accelerations and decelerations so that each step of the bag-making operation, e.g., seaming, label application, die cutting, finished bag cut-off, is performed in precisely the right position on the bag. Dimensional stability of a bag substrate is important for such operations from the standpoint of maintaining registration and avoiding deformation as the material rapidly starts and stops during its progression through the bag-making equipment.

The substrate must also be a material that can be seamed with adequate strength to withstand filling operations, transportation and handling. Bags manufactured from mesh fabrics can be problematic in this respect, particularly those that comprise a delicate, net-like material and/or have only limited surface area available for seaming. Limited area for contact between opposite layers of the fabric tends to make heat sealed seams weak, if effective at all. Seaming with adhesives tends to be aesthetically unattractive. Sewn seams add cost and are often ineffective due to the small surface area of the open mesh fabric.

Attempts to produce an improved mesh bag have been further complicated by industry desire to incorporate printed or printable labels into the design of the bag, yet still preserve the efficiency of high-speed bag-making processes and maintain minimal cost and usage of label and mesh fabric materials. Examples of such attempts may be found in U.S. Pat. Nos. 6,190,044, 6,030,120 and 6,024,489 to Fox et al. The Fox et al. patents disclose a side-sealed bag, wherein one side of the finished bag is a mesh fabric and the other side of the bag is a film that serves as the label. Although the Fox et al. bags may be produced via high-speed bag-making machines, such bags are clearly disadvantageous, as half the bag is formed from costly film/label material, thus countering any savings that would ordinarily result from an efficient high-speed bag-making process.

Furthermore, the film material utilized to manufacture the Fox et al. mesh fabric/film bag is not as structurally durable as the fabric material (i.e., CLAF) utilized to manufacture the mesh fabric/film bag, as the film material is basically a low-density polyethylene/ethylene-vinyl acetate blend (LDPE/EVA), suited for use in continuous sealing equipment. The current Volm side sealed bag and Fox et al. tubed bags use oriented polyester or polypropylene films with linear LDPE (LLDPE) or similar material laminated thereto so as to allow heat-sealing of the films to the CLAF fabric. The need for the PET or OPP label materials arises from the need to apply the film/label in an intermittent mode, utilizing high temperatures (320 deg. F est.) and short dwell times.

Therefore, it is readily apparent that there is a need for a side-sealed mesh bag having a label section, wherein traditional attributes of conventional mesh bags, such as breathability and contents-visibility are provided, and high-speed bag-making machine criteria are met with minimal cost and usage of label and mesh fabric materials.

BRIEF SUMMARY OF THE INVENTION

Briefly described, in a preferred embodiment, the present invention overcomes the above-mentioned disadvantages, and meets the recognized need for such a device by providing a side-sealed mesh bag having a label section comprising two mesh fabric sheets heat sealed to opposing ends of a sheet of lower cost label material, wherein the heat-sealed fabric/label sheets are then V-folded along a central axis and the resulting seams heat sealed via a pre-applied heat seal strip.

According to its major aspects and broadly stated, the present invention in its preferred form is a side-sealed mesh bag having a label section comprising, in general, mesh fabric sheets, a label sheet and thermoplastic sealing strips.

More specifically, the present invention is a side-sealed mesh bag having a label section comprising substantially rectangular shaped first and second mesh fabric sheets heat sealed to opposing ends of a substantially rectangular shaped label sheet, wherein V-folding of the heat-sealed fabric/label sheet along a central axis forms a closed, butt end, an opposing end, and at least two longitudinal seams extending from the butt end to the opposing end. Specifically, the first fabric sheet is generally substantially wider than the combined widths of the second fabric and label sheets. As such, the central axis from where the V-fold originates is formed on the first fabric sheet. Furthermore, each longitudinal seam comprises a seam section formed from the first fabric sheet and a seam section formed from both the second fabric sheet and label sheet, wherein the seam section of the first fabric sheet has heat-sealed thereon a thermoplastic sealing strip, applied in the cross machine direction such that when the fabric/label sheet is folded on a central axis, the sealing strip extends perpendicular to the fold and along the full height or length of the finished bag.

The thermoplastic sealing strip, also referred to herein as thermoplastic film strips or just film strips, generally comprises a thermoplastic resin or blend of resins having a melting temperature or heat seal temperature lower than the melting temperature of the fabric and label sheets in general. As a result, when the heat-sealed fabric/label sheets are V-folded, the thermoplastic sealing strip formed on the seam section of the first fabric sheet contacts the seam section of both the second fabric sheet and the label sheet, whereupon applied pressure and heat seal the side seams, thus forming the bag.

A feature and advantage of the present invention is its ability to be well suited for use in automated bag filling operations owing to the bags' dimensional stability and ability to be wicketed.

A feature and advantage of the present invention is its strength.

A feature and advantage of the present invention is its flexibility.

A feature and advantage of the present invention is its breathability.

A feature and advantage of the present invention is its contents-visibility.

A feature and advantage of the present invention is its ability to be manufactured with ease on industrial high-speed automated bag-making equipment.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1–8, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
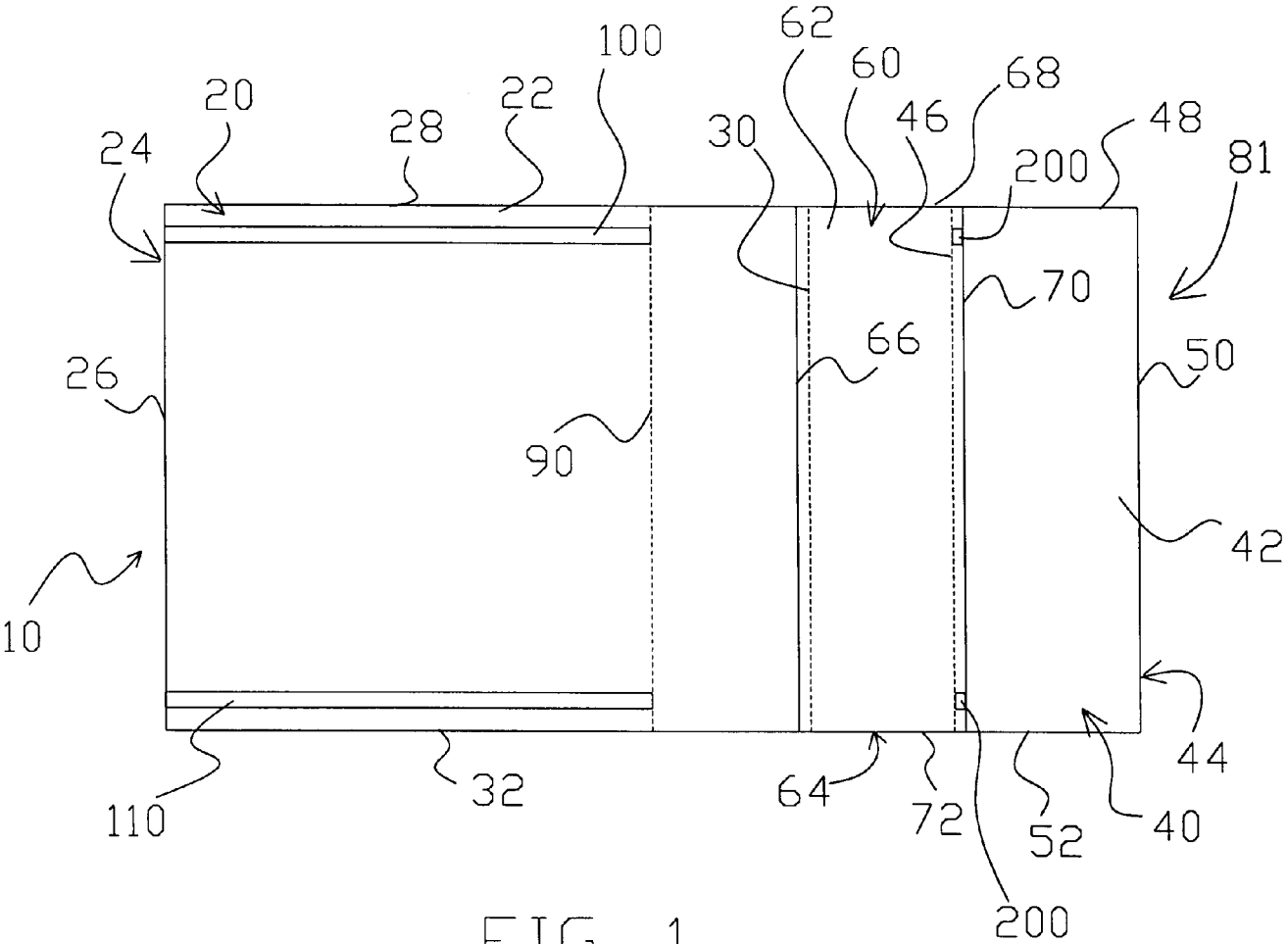
FIG. 1 is a top view of a side-sealed mesh bag having a label section according to a preferred embodiment of the present invention showing the bag in an unfolded position.
Figure 2:
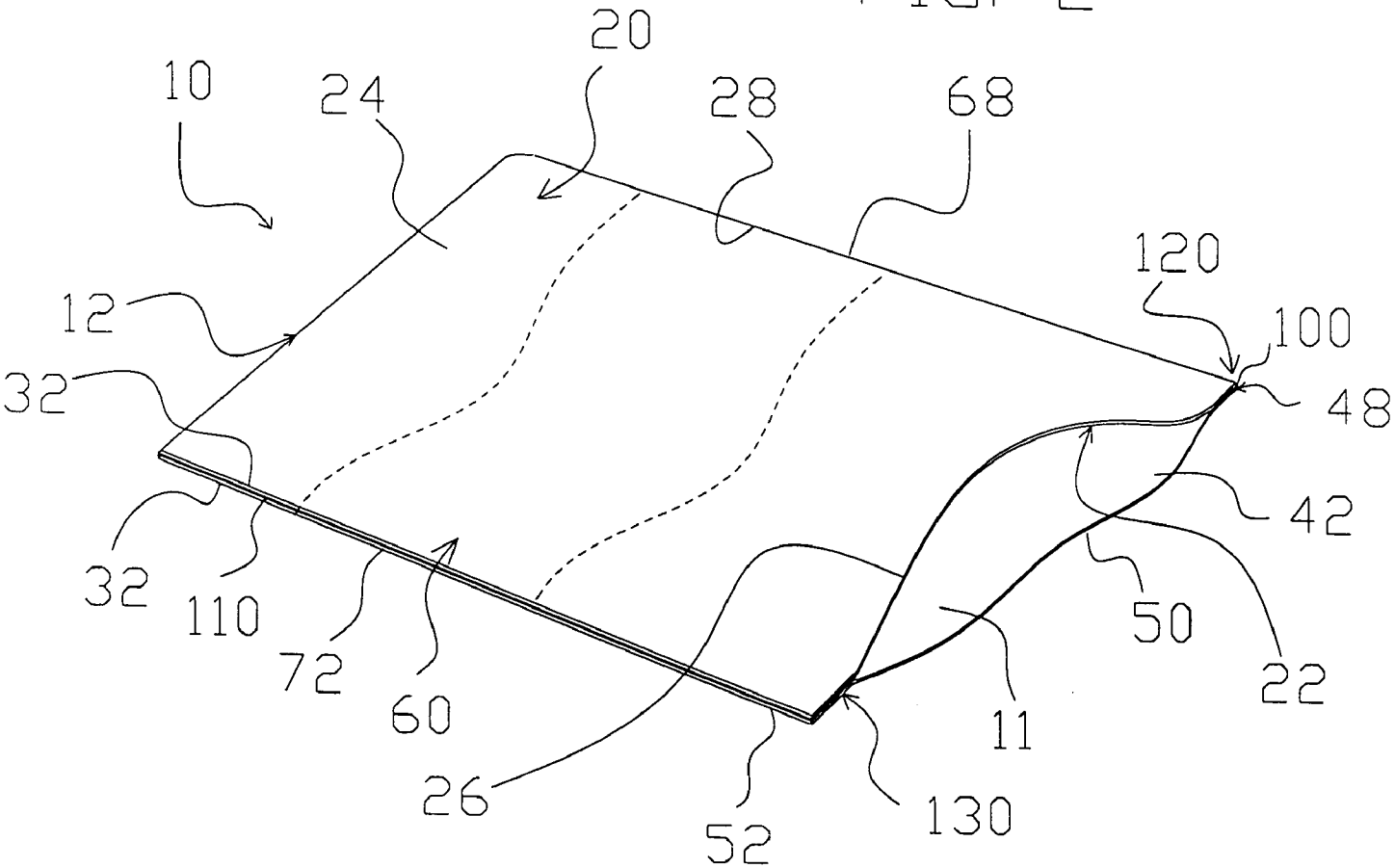
FIG. 2 is a perspective view of a side-sealed mesh bag having a label section according to a preferred embodiment of the present invention, showing the bag in a folded position.

Referring now to FIGS. 1–2, the present invention in its preferred embodiment is a bag 10, wherein bag 10 is preferably a side-sealed mesh bag having a label section generally comprising a first mesh fabric section 20, a second mesh fabric section 40, a label section 60 and at least two thermoplastic sealing strips 100 and 110.

Specifically, first fabric section 20 is preferably substantially rectangular shaped and preferably has top and bottom surfaces 22 and 24, respectively, and first, second, third and fourth edges 26, 28, 30 and 32, respectively. Similarly, second fabric section 40 is preferably substantially rectangular shaped and preferably has top and bottom surfaces 42 and 44, respectively, and first, second, third and fourth edges 46, 48, 50 and 52, respectively. Preferably, first fabric section 20 has a larger width than second fabric section 40. First and second fabric sections 20 and 40, respectively, can be supplied as individual sheets of mesh fabric; however, for high-speed bag-making machine processes, first and second fabric sections 20 and 40, respectively, are preferably supplied as continuous mesh fabric rolls.

Label section 60 is preferably substantially rectangular shaped and preferably has top and bottom surfaces 62 and 64, respectively, and first, second, third and fourth edges 66, 68, 70 and 72, respectively. Preferably, second fabric section 40 has a slightly larger width than label section 60. Label section 60 can be supplied as individual sheets of label material; however, for high-speed bag-making machine processes, label section 60 is preferably supplied as a continuous label material roll.

First edge 66 of label section 60 preferably overlaps and is preferably continuously longitudinally heat sealed to third edge 30 of first fabric section 20, and third edge 70 of label section 60 preferably overlaps and is preferably continuously longitudinally heat sealed to first edge 46 of second fabric section 40. Because first and second fabric sections 20 and 40, respectively, and label section 60 are preferably supplied as continuous rolls of fabric or label material, continuous longitudinally heat sealing of first and second fabric sections 20 and 40, respectively, to label section 60 preferably forms a roll of bag substrate or prepared web 80 having fabric/label/fabric panels, wherein each bag 10 is thereby preferably formed from a sectional piece or sheet 81 of prepared web 80 and therefore has fabric/label/fabric panels joined by continuous longitudinal heat seals, as best illustrated in FIG. 1.

By virtue of first fabric section 20 being larger in width than the combined widths of second fabric section 40 and label section 60, longitudinal central axis 90 is generally disposed on first fabric section 20. Moreover thermoplastic sealing strips 100 and 110 are applied proximate to second edge 28 and fourth edge 32, respectively, on top surface 22 of first fabric section 20, and extend preferably from first edge 26 of first fabric section 20 to central axis 90.

Referring specifically now to FIG. 2, upon V-folding of unfolded bag 10 along central axis 90, a bottom, or butt end, 12 is formed. The fabric and/or label material on each side of the fold extends from the fold and terminates at opposing end 11 of bag 10. Opposing end 11 can be open, for example prior to filling thereof, or it can be closed, for example after filling of the bag. Any suitable means for effecting such closure can be used, such as stitching or sewing, lacing and tying, stapling, use of adhesives, heat sealing, use of rib-and-groove elements and/or twist-type closures.

Furthermore, V-folding of bag 10 along central axis 90 forms first seam 120 by causing second edge 28 of first fabric section 20 to contact second edge 68 of label section 60 and second edge 48 of second fabric section 40, wherein second edge 28 of first fabric section 20 also partially contacts or folds back on itself, proximate to central axis 90, by virtue of first fabric section 20 having a larger width than the combined widths of label section 60 and second fabric section 40. Similarly, V-folding of bag 10 along central axis 90 further forms second seam 130 by causing fourth edge 32 of first fabric section 20 to contact fourth edge 72 of label section 60 and fourth edge 52 of second fabric section 40, wherein fourth edge 32 of first fabric section 20 also partially contacts or folds back on itself, proximate to central axis 90, by virtue of first fabric section 20 having a larger width than the combined widths of label section 60 and second fabric section 40.

Applied pressure and heat to seams 120 and 130 cause thermoplastic sealing strips 100 and 110 to melt and heat seal seams 120 and 130, thus giving bag 10 structure. By virtue of heat sealing seams 120 and 130, the respective edges of first and second fabric sections 20 and 40, respectively, and label section 60 that form seams 120 and 130 are embedded in thermoplastic sealing strips 100 and 110, thereby providing strength despite low surface area of the mesh fabric at seams 100 and 110. Butt end 12 and opposing end 11 of bag 10, together with the heat sealed seams 120 and 130, define a perimeter of the fabric/label material that forms a space or volume for receiving and containing contents placed into bag 10.

Heat-sealed side seams 100 and 110 can be as wide as necessary to effectively bond the fabric/label material at seams 100 and 110. Seam widths of about ¼ inch to about 1 inch are preferred, with seam widths of about ¼ inch to about ½ inch being well suited for bags of up to about 10 pounds capacity and widths of about ½ inch to about 1 inch being well suited f or bags in the range of about 10 to about 20 pounds capacity. As will be appreciated by those skilled in the art having the benefit of the description provided herein, optimum seam widths will vary depending on size, construction and intended use of bag 10.

While the bag illustrated in FIGS. 1 and 2 represents a preferred. construction for some end uses, it will be appreciated that a wide range of modifications and alternatives to the preferred construction are contemplated according to the invention. In one alternative embodiment, referred to as a lipped bag, the mesh fabric at the open end of the bag is somewhat shorter on one side of the bag than the other to facilitate use of the bags in automated filling operations; this also can facilitate closing of the open end of the bag because the additional fabric from the longer side of the bag provides a convenient flap that can simply be folded over onto the shorter side and heat sealed, stitched or otherwise sealed to form an effective closure for the bag. In yet another embodiment, gussets can be incorporated into the final bag structure such as by folding during forming of the bags. In another embodiment, a plurality of bags connected top-to-bottom or side-to-side can be provided in the form of a roll, with separation of individual bags being accomplished in connection with filling or other use of the same. The bags can also be adapted for use in form-fill-seal applications.

According to another embodiment of the invention, the invented bags can be provided in the form of a stack made up of a plurality of bags disposed on a wicket. Wicketing facilitates use of bags with high speed, automated bag filling equipment. The wicket generally is in the form of a wire or rod having two right angle bends and adapted to receive and hold in place the bags by means of holes punched or otherwise made in an end of the bags, and most preferably in the longer side of a lipped bag at the open end thereof. Advantageously, the dimensional stability of the bag fabric aids in maintaining the holes in registration and also prevents fraying of the fabric due to the holes.

First and second fabric sections 20 and 40, respectively, of bag 10 can be constructed, in general, from any open mesh fabric to which can be heat sealed thermoplastic strips 100 and 120, or any additional thermoplastic sealing strips, to form seams 120 and 130. Woven, knit, scrim, extruded net and nonwoven fabrics can be utilized provided they have sufficient openness of construction to allow adequate visibility of the contents of bag 10. Preferably, the open mesh fabric also is suitable for processing into bags using high-speed bag-making equipment. To that end, fabrics having a coefficient of friction according to ASTM 3334-80 Section 15 of less than about 30° and dimensional stability such that the fabric, when folded and seamed, can withstand at least about one G-force without substantial deregistration are especially preferred. Most preferred fabrics have coefficients of friction of about 15° to about 25° and can withstand G-forces of at least about 2 without substantial deregistration.

Woven and knit fabrics can be constructed and prepared in any suitable manner. From a cost and performance standpoint, so-called tapes or slit-film ribbon yarns are preferred for such fabrics. Any suitable weave or knit providing an appropriate level of openness to impart breathability of the fabric and visibility of the contents of bag 10 can be utilized. Examples include flat and leno weave fabrics and knitted fabrics. Such fabrics can also be employed with coatings or heat-sealing to provide enhanced dimensional stability and fray resistance to the same. Of course any such coating must be applied to the fabric in a discontinuous manner, that is, so that less than the entire surface of the fabric is coated, in order to ensure that the coated fabrics have adequate breathability. Various techniques for discontinuous coating of fabrics are well known. An example is stripe coating as disclosed in U.S. Pat. No. 4,557,958. Heat-sealing also can be utilized to improve dimensional stability of such fabrics, as will be appreciated by persons skilled in the art. In the case of these fabrics, whether a leno weave, flat weave, knit or otherwise, the yarns of the fabric or such yarns and any coatings will generally comprise a thermoplastic resin composition. It also is contemplated to form the fabric or coated fabric from thermoplastic resin compositions having different melting points, with a higher melting resin being present to provide strength and integrity to the fabric and a lower melting resin being present, either as a discontinuous coating on the surface of the fabric or laminated to or as part of the yarns thereof, e.g., as coextruded tapes, to provide for heat bonding of the yarns of the fabric to one another and, in turn, greater dimensional stability and resistance to fraying. Like considerations are applicable to scrims.

Nonwoven netlike fabrics, extruded nets and scrims are also suitable as open mesh fabrics for the invented bags. These materials typically have a reticulated or netlike structure, with a plurality of interconnected, intersecting fibrils or ribs defining a plurality of open spaces in the fabric. The fibrils preferably are disposed in a regular pattern, thereby forming a grid that defines the open spaces. Depending on the pattern formed by the fibrils, the open spaces may all be the same size and shape or they may be of different sizes and/or shapes. The netlike webs comprise one or more thermoplastic resin compositions or formulations. These materials can be made by various means such as thermally bonding a series of filaments laid down in a predetermined pattern, controlled slitting and/or splitting and stretching of film-forming thermoplastic resin compositions to achieve a netlike structure and others. Lamination of two or more such structures, preferably with at least two layers thereof disposed such that the machine direction of one is essentially perpendicular to the machine direction of another, can be employed to provide materials of greater strength than single layer structures.

Whether the fabric is a woven, knit or scrim material or nonwoven, preferred thermoplastic resins therefor are polyesters and polyolefins such as polypropylene, polyethylene and copolymers of propylene and polyethylene. High, medium, low and linear low density polyethylenes are contemplated, as are so-called metallocene polyolefins. Preferred combinations of resins are polypropylene or polyethylene terephthalate for strength or load-bearing components of the fabric and polyethylene or blends thereof with polypropylene for the heat-sealable components thereof and high-density polyethylene for the strength or load-bearing components and low-density polyethylene for the heat-sealable components.

Most preferably, bag 10 is formed from a cross-laminated nonwoven fabric made from coextruded film that has been split and stretched. Such fabrics can comprise any suitable film-forming thermoplastic resin. Among the film-forming materials which can be employed in making the cross-laminated thermoplastic net-like webs are thermoplastic synthetic polymers, including polyolefins such as low density polyethylene, linear low density polyethylene, polypropylene, high density polyethylene, so-called metallocene polyethylenes, random copolymers of ethylene and propylene and combinations of these polymers; polyesters; polyamides; polyvinyl polymers such as polyvinylalcohol, polyvinylchloride, polyvinylacetate, polyvinylidene-chloride and copolymers of the monomers of these polymers. Preferred materials are polyesters and polyolefins such as polypropylene, random copolymers of propylene and ethylene, and a combination of high-density polyethylene and low-density polyethylene. Especially preferred resins are polyethylenes and combinations thereof such as a layer of high-density polyethylene and a layer of low-density polyethylene. These thermoplastic synthetic polymers may contain additives such as stabilizers, plasticizers, dyes, pigments, anti-slip agents, and foaming materials for foamed films and the like.

To form the cross-laminated, nonwoven, open mesh fabrics, thermoplastic material can be formed into a film by extrusion, coextrusion, casting, blowing or other film-forming methods. The thickness of the film can be any workable thickness with a typical thickness in the range of about 0.3 to about 20 mils. Coextruded films can be used containing two or more layers of thermoplastic material, such as a layer of polypropylene and a layer of low-density polyethylene, wherein one layer provides about 5 to about 95% of the thickness of the film and the second layer provides the remaining thickness. Such coextruded structures most preferably are formed from first and second thermoplastic resin compositions wherein the first composition is a higher melting point resin component that provides strength or load-bearing capability to the fabric and the second composition is a lower melting point resin that has good adhesion to the first composition and can also provide heat sealability of the fabric to other materials.

Another type of coextruded film construction comprises a three-layer construction. Each of the three layers can be a different: thermoplastic polymer. More often, however, the three-layer coextruded film is made with the same material for the exterior two layers and a different polymer for the interior layer. The interior layer can provide about 5 to about 95% of the film thickness. Preferably, the interior layer provides from about 50 to about 80% of the thickness and the outer two layers make up about 20 to about 50% of the thickness, with the outer two layers most preferably having about equal thickness. Coextruded films are typically used for making cross-laminated thermoplastic net-like webs in which one layer of film is cross-laminated and bonded to a second layer of film with the exterior layers of the films containing compatible and easily bondable thermoplastic materials such as low density polyethylene or linear low density polyethylene.

The film can be oriented by any suitable orientation process. Typical stretch ratios are about 1.5 to about 15 depending upon factors such as the thermoplastic used and the like. The temperature range for orienting the film and the speed at which the film is oriented are interrelated and dependent upon the thermoplastic used to make the film and other process parameters such as the stretch ratio, as well known to those skilled in the art.

A particularly preferred nonwoven netlike fabric for the invented bags is a so-called "cross laminated airy fabric," also known by the Nippon Petrochemical Company Ltd. trademark CLAF®. This material can be characterized as a net-like web or nonwoven and is described in detail in commonly assigned U.S. Pat. No. 5,182,162, which is incorporated herein by reference. As described in that patent, such fabrics have a net-like structure comprising a multiplicity of aligned thermoplastic fibril- or rib-like elements wherein first elements are aligned at about a 45° to about 90° angle to second elements and the elements define borders for multiple void areas of the net-like nonwoven structures. The borders which define the void areas can be parallelogram-shaped such as a square, rectangle or diamond, or ellipse-shaped such as a circle or ellipse, depending on the process of formation of the net-like web. The elements which define the borders can be in the same plane or different planes. Elements in different planes can be laminated to each other. A preferred thermoplastic net-like web is a cross-laminated thermoplastic net-like web having a uniaxially oriented thermoplastic net or web laminated to a second oriented net or web of a thermoplastic such that the angle between the direction of orientation of each film is about 45° to about 90°. The webs can have continuous or discontinuous slits to form the void areas of the net-like web and can be formed by any suitable slitting or fibrillation process. The net-like structure can also be formed by other means such as forming on one side of a thermoplastic film a plurality of parallel continuous main ribs and forming on the opposite side of the film a plurality of parallel discontinuous ribs with the film being drawn in one or two directions to open the film into a network structure, punching or stamping out material from a film to form a pattern of holes in the film and stretching the film to elongate the spaces between the holes. The net-like structure can also be formed by extrusion with the net being oriented by a stretching operation.

Cross-laminated thermoplastic net-like webs can be made by bonding two or more layers of uniaxially oriented network structures together wherein the angle between the directions of uniaxial orientation of the oriented films is between about 45° to about 90° in order to obtain good strength and tear resistance properties in more than one direction. The orientation and/or formation of the network structure in the films can be completed before the bonding operation or it can be done during the bonding process. Bonding of two or more layers of network structure films can be accomplished by applying an adhesive between the layers and passing the layers through a heating chamber and calender rolls to bond the layers together, or by passing the layers through heated calender rolls to thermally bond the layers together, or by using ultrasonic bonding, spot bonding or any other suitable bonding technique.

As described in U.S. Pat. No. 4,929,303, the cross-laminated net-like webs can be nonwoven cross-laminated fibrillated film fabrics as described in U.S. Pat. No. 4,681,781. The cross-laminated fibrillated films are disclosed as high density polyethylene (HDPE) films having outer layers of ethylene-vinyl acetate coextruded on either side of the HDPE or heat seal layers. The films are fibrillated, and the resulting filament-like elements are spread in at least two transverse directions at a strand count of about 6–10 per inch. The spread fibers are then cross-laminated by application of heat to produce a nonwoven fabric of 3–5 mils thickness with about equal machine direction and transverse direction strength properties well suited for thin, open mesh fabrics of exceptional strength and durability. As disclosed in U.S. Pat. No. 4,929,303, the open mesh fabric is suitable for joining with other materials, such as papers, films, foils, foams and other materials, by lamination or extrusion coating techniques, or by sewing or heat sealing. The fabric may be of any suitable material, but is preferably low-density polyethylene, linear low-density polyethylene, polypropylene, blends of these polymers and polyesters. The open mesh fabrics generally have an elongation (ASTM D1682) less than about 30%; an Elmendorf tear strength (ASTM D689) of at least about 300 g; and a breakload (ASTM D1682) of at least about 15 lb/in. Reported uses of cross-laminated fibrillated film fabrics include shipping sacks for cement, fertilizer and resins, shopping, beach and tote bags, consumer and industrial packaging such as envelopes, form, fill and seal pouches, and tape backing, disposable clothing and sheeting, construction film and wraps, insulation backing, and reinforcement for reflective sheeting, tarpaulins, tent floors and geotextiles, and agricultural ground covers, insulation and shade cloth.

Cross-laminated thermoplastic net-like webs are available from Atlanta Nisseki CLAF, Inc. under the designation CLAF®, with examples of product designations including CLAF S, CLAF SS, CLAF HS and CLAF MS. Such fabrics are available in various styles and weights. The style designated MS is a preferred fabric for the invented bags. MS style CLAF® fabric has a basis weight of about 18 g/m$^2$ and a thickness of approximately 7.8 mils, as determined by ASTM D3776 and ASTM D1777, respectively. Properties of CLAF® fabrics that make them well suited materials of construction for manufacture of the invented bags using high-speed, automated bag-making equipment include coefficients of friction of about 15° to about 25° and dimensional stability sufficient to withstand acceleration of at least about 2 g without significant deregistration. As an indicator of such dimensional stability, grab tensile testing according to ASTM 5034-95 with test specimens cut at a 45° angle to the fabric machine direction can be used, with loads at 10% elongation of about 2.5 pounds characterizing the fabrics. Other typical properties of this fabric include machine direction grab tensile strength of about 35 pounds and elongation of about 15% according to ASTM 5034-95.

Thermoplastic sealing strips 100 and 110 to which the mesh fabric and label material of the invented bags are heat sealed to form longitudinal seams, comprise at least one thermoplastic resin composition having a melting or softening point that is lower than that of the mesh fabric and label material. In the case of open mesh fabrics composed of two or more resin compositions with different melting temperatures, the strip resin preferably melts at a temperature lower than the higher melting component of the fabric. Preferably, the melting point of the strip resin is at least about 10° C. below the melting point of the fabric resin and label material to facilitate heat-sealing without melting or softening of the fabric and label material. More preferably, the melting point differential is about 30° C. to about 60° C. The resin of the seaming strip should also provide sufficient seal strength and adhesion so that the bags hold product without breaking or failure at or adjacent to the seams during filling, handling and use Preferably, the open mesh fabric and thermoplastic strips 100 and 110 are composed of resins and so-configured as to provide longitudinal seams having a strength of at least about 5.0 lbs/2 inches as measured by ASTM D 5035-95. More preferably, seam strength is at least about 8 lbs/2 inches.

The choice of thermoplastic resin for sealing strips 100 and 110 depends in part upon the amount of heat and pressure that can be applied thereto at seams 120 and 130 of bag 10 without impacting the integrity of bag 10. The resin for strips 100 and 110, and any other additional sealing strips, will also depend on the choice of resin for the open mesh fabric. The thermoplastic resin may be a single resin or a blend of two or more compatible resins. In the case where HDPE is used as the higher melting temperature component of the mesh-like fabric, the thermoplastic film strip is preferably an ethylene alpha-olefin polymer or copolymer or blend of compatible polymers having a melting temperature below that of HDPE. The thermoplastic synthetic polymer resins may contain additives such as stabilizers, dyes, pigments, anti-slip agents, foaming agents and the like.

The invented bags are manufactured by a process comprising the steps of applying to first fabric section 20, at selected positions, strips 100 and 110 of a thermoplastic resin to which first fabric section 20 is heat sealable, folding first fabric section 20 along central axis 90, wherein central axis 90 and strips 100 and 120, and any additional strips, are perpendicularly or essentially perpendicularly disposed to one another, and heat sealing first fabric section 20 to second fabric section 40 and label section 60 via strips 100 and 110 and/or any additional strips. In one embodiment, the bags are particularly suited for manufacture using high-speed or automated bag-forming equipment, although other bag-making machinery can also be utilized. The process can also comprise additional steps including cutting the fabric, before or after folding or heat sealing, into individual bags or appropriate sizes for individual bags, wicketing and stacking. In one embodiment, manufacture of bag stock comprising open mesh fabric with strips of heat sealable film comprising a thermoplastic resin affixed thereto, and most preferably heat sealed to the fabric along an edge of the film, is conducted in a first operation and the stock is converted into individual bags in a subsequent operation. Preferably, the bag stock is prepared in the form of roll goods to facilitate collection and handling of the bag stock and feeding the same to the ultimate bag-making step. In another embodiment, the bag stock as described above is conveyed directly to the bag-making operation comprising folding the bag stock and heat sealing of side seams.

In greater detail, film strips 100 and 110 are generally applied to the first fabric section 20, extending from first edge 26 to central axis 90. Strips 100 and 110 can be secured to first fabric section 20 by any means effective to provide a strong enough bond between first fabric section 20 and strips 100 and 110 to stand up to downstream processing steps. Preferably, strips 100 and 110 are lightly heat sealed to first fabric section 20 using a sealing bar or other strip application equipment. Most preferably, the heat-sealable material in the form of strips of thermoplastic film 100 and 110 are affixed to first fabric section 20 in the cross machine direction at uniformly spaced intervals and at a distance of about one-half the width of sheet 81, as best illustrated in FIG. 1.

Film strips 100 and 110 are preferably applied to approximately one-half the width of sheet 81 so that when sheet 81 is folded along central axis 90, film strips 100 and 110 will extend longitudinally along the full length or height of bag 10. The exact length of the film strips across the width of first fabric section 20 will depend on the closing mechanism employed for closing bag 10, with the length of the strip being somewhat less than half the width of sheet 81 if an overlap of bag fabric material is used to close the open end of bag 10. In cases where the bags are gusseted with a one inch deep gusset, for example, the film strip is preferably applied at a distance about one inch more than one half the width of sheet 81 so that each layer in the gusset is touching the film.

The width and thickness of film strips 100 and 110 should be sufficient for effective heat sealing to form the side seams of bag 10. In one embodiment of the process, the film strips are generally somewhat greater than twice the desired width of the seal for the side seam of the finished bags, thereby allowing bags to be slit at the side seam so as to reduce the frequency of applying the strips to first fabric section 20 in the process. For example, with a one-inch wide seal bar, a 1 and ¼ inch wide film strip may be used and the seam slit to form two, one-half inch wide side seams. The slightly wider film strip is used to ensure that only fabric with heat-sealable film between layers of the fabric is exposed to the hot seal bar.

Thickness of the film can vary depending on whether the film is a single layer or a multi-layer film. For single layer films, suitable thicknesses are such as to effectively heat seal the seams. Generally, thicknesses of about 0.5 to about 10 mils are well suited for this purpose, with about 1 to about 5 mils being preferred. For multi-layer films, the thickness will vary depending on the characteristics the film is expected to provide to the heat-sealing of the seams. For example, a multi-layer film may comprise two outer layers of a lower melting temperature resin to enhance heat-sealing characteristics and an inner layer of a higher melting temperature resin to strengthen the seam.

Figure 3:
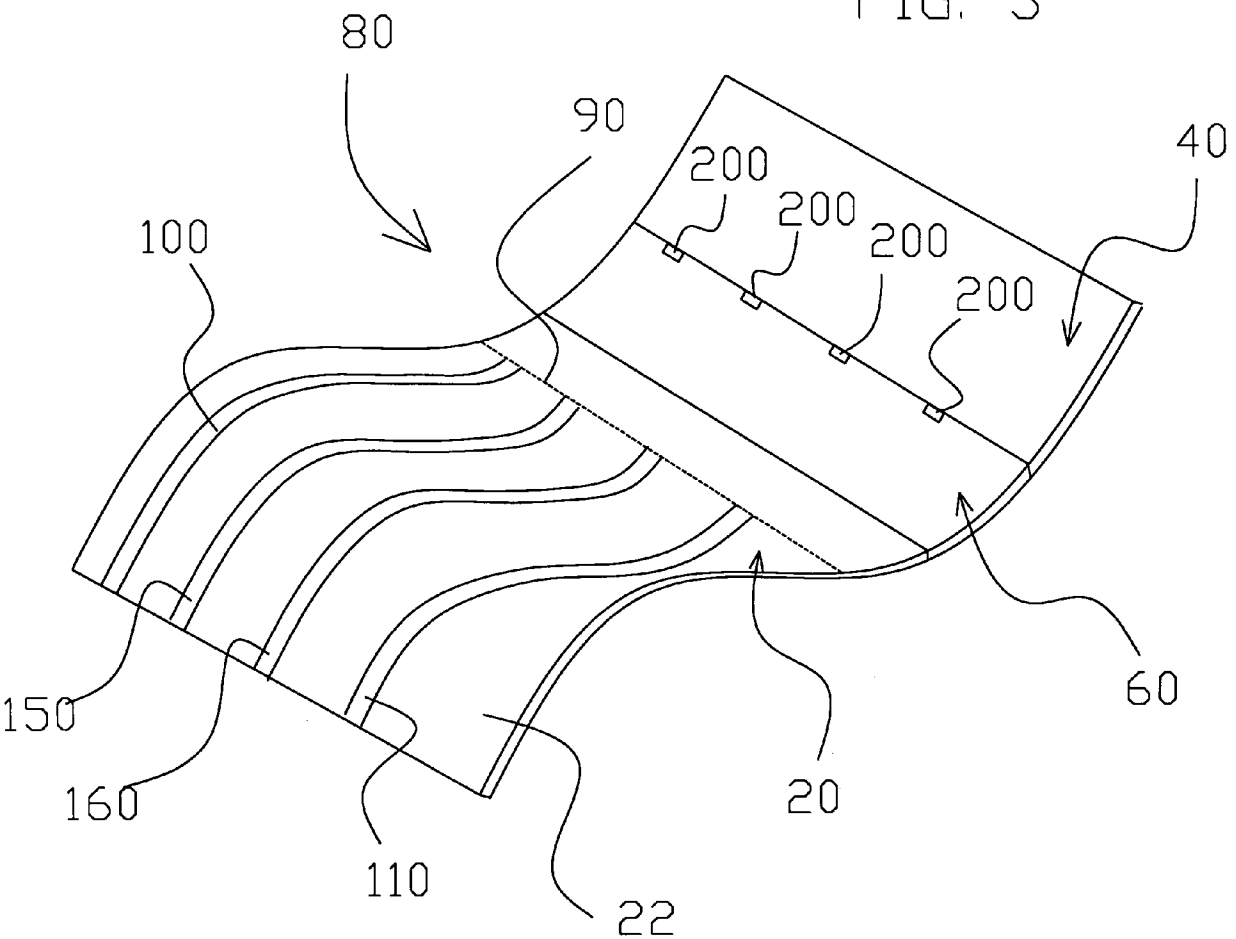
FIG. 3 is a perspective view of a section of the preferred web to which has been applied thermoplastic film strips for subsequent heat-sealing to form the seams of a side-sealed mesh bag having a label section according to a preferred embodiment of the present invention.
Figure 8:
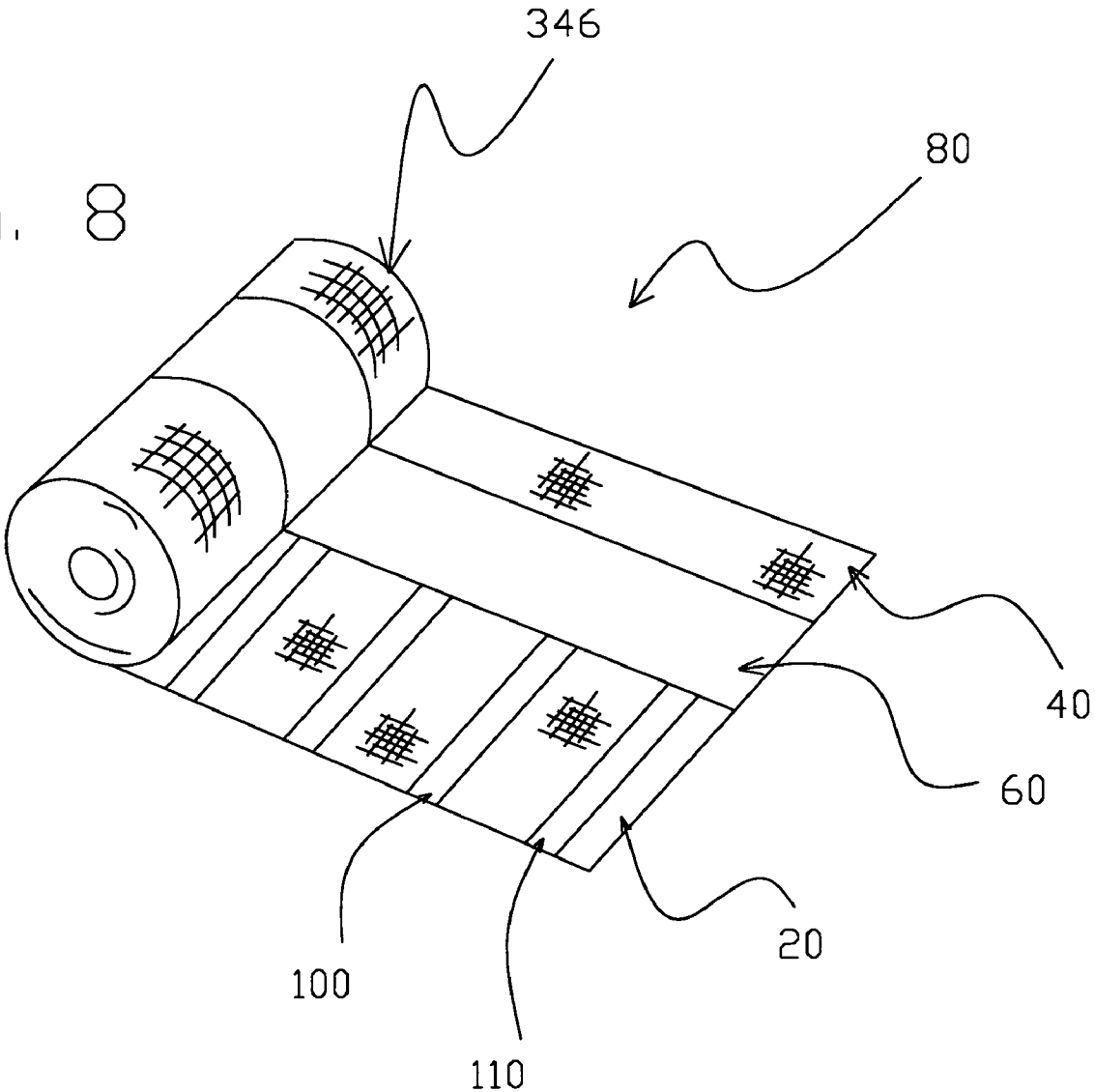
FIG. 8 is a perspective view of a roll of the bag substrate or bag stock of FIG. 3 for making side-sealed mesh bags having a label section according to a preferred embodiment of the present invention.

Referring now to FIG. 3, there is illustrated a portion of preferred web 80 showing sealing strips 100 and 110 and additional strips 150 and 160 applied to top surface 22 of first fabric sheet 20. Fabric in this form is suited for use as bag stock, in flat or roll form, for manufacture of bags. Thus, the present invention also provides bag stock comprising an open mesh fabric having a plurality of strips of heat sealable thermoplastic resin affixed thereto, with the strips being positioned at essentially regular intervals along a lengthwise direction of first fabric section 20 and each strip being affixed across a widthwise direction of first fabric section 20. As seen from FIG. 3, heat sealable strips 100, 110, 150 and 160 are secured to top surface 22 of first fabric section 20 at substantially regular intervals. The strips conveniently are formed from a thermoplastic film and are lightly heat sealed or tacked to first fabric section 20. FIG. 8 illustrates prepared web 80 from which sheets 81 are cut, having affixed strips of thermoplastic resin film 100 and 110 thereon, wherein prepared web 80 is provided in the form of roll 346. Generally, heat-sealable film strips 100 and 110 are about twice the desired width used in the side seams of the open mesh bags for bags formed on high-speed bag-making equipment. Bottom or butt end 12 of bag 10 is formed by folding unfolded bag 10 on a central axis 90 SO that each side seam of bag 10 comprises a section of first fabric section 20 and a section of second fabric section 40 and label section 60, wherein heat-sealable strips are positioned on about one-half the width of sheet 81 and spaced on first fabric section 20 so that bag 10 side seams are formed from heat sealing first fabric section 20 to second fabric section 40 and label section 60 via the thermoplastic sealing strips. Each film strip 100, 110, 150 and 160 is thus cut in half longitudinally as the bags are formed and each strip 100, 110, 150 and 160 thus provides two side seams.

Heat-sealing of the fabric/label sections to the heat sealable strips is conducted after the strips are properly positioned with respect to the side seams. The strips, preferably sandwiched between the fabric/label sections from each side of the fold, are subjected to sufficient heat and pressure to soften or melt the strip to effect a heat-seal with the fabric/label material. Temperatures and pressures effective to provide the heat-seal will depend in part on the particular thermoplastic strips and open mesh fabric used in making bag 10, as well as the thicknesses of the strips, fabric and label materials utilized. The applied heat and pressure, of course, should not be so great as to destroy the integrity of bag 10. In a preferred embodiment of the invented process, wherein a MS grade CLAF® fabric and an ethylene alpha-olefin polymer such as Affinity PF 1140 or blends thereof with polyethylenes for the heat sealable strips are utilized, temperatures of about 360° to 400° F. and pressures of about 40 to 60 psi provide an effective heat seal even at short heating times on the order of one-half second or less.

In heat-sealing the heat sealable strips to the fabric/label sections to form the side seams, any suitable heat seal means can be used. Examples include seal bars, heated sealing frames and the like. In general, when using a seal bar, temperatures of about 200° to about 450° F., pressures of about 30 to about 75 psi and dwell times of about 0.2 to about 2 seconds are preferred to form a seam having substantial strength when open mesh, nonwoven cross-laminated netlike fabrics such as CLAF® fabrics are used for the open mesh bag fabric.

Label section 60 may conveniently be made from printable polymeric films available commercially such as preferably composites of low-density polyethylene blended with ethylene-vinyl acetate, linear low-density polyethylene or metallocene polyethylene to improve sealing or a multilayer film such as, for exemplary purposes only, a high-density polyethylene/linear low-density polyethylene/blend coextruded. Such films are generally available from Winpak Inc., in 2 and 3 mil thickness. Coated films also can be used. Label section 60 may also be made from a film comprising linear low-density polyethylene/polyester or from oriented polypropylene film coated with low or linear low-density polyethylene. A label made from 1.25 mil linear low density polyethylene and 0.5 mil polyester has been found to have acceptable performance properties in this application. Depending on economics, a film of linear low-density polyethylene only can also be used, although the printability of such film is not as good as that of some of the composite films.

A preferred apparatus for manufacture of bag stock for making the invented bags, comprising sealing strips 100, 110, and additionally strips 150 and 160, of a thermoplastic resin affixed to top surface 22 of first fabric section 20 at selected locations. Heat sealing the edges of first fabric section 20 and second fabric section 40 to opposing edges of printed or printable label section 60, and means for advancing each of a bag substrate, thermoplastic polymeric film and label section from sources thereof continuously through the apparatus such that prepared web 80 is formed; means for intermittently stopping and resuming passage of prepared web 80 through the apparatus based on indicators or label eye marks 200 detectible on label section 60; a strip applicator disposed in the path of the prepared web 80 comprising means for transversely affixing a leading edge of thermoplastic polymeric film strips 100, 110, 150 and 160 to prepared web 80 and means for transversely cutting thermoplastic polymeric film strips 100, 110, 150 and 160 at a selected distance upstream of the leading edge thereof; a heat sealing device located in the path of the prepared web 80 downstream of the point of contact of the edges of label section 60 and second fabric section 40 to the respective edges of first fabric section 20; and takeoff means for continuously removing bag stock from the apparatus. Preferably the label section 60 is advanced through the apparatus from a double width roll of label material by means of a braked unwind shaft, with a cutting blade or other suitable slitting device positioned in the path of label section 60 for cutting it into two bands, each of which is advanced through adjustable position dual turn bars onto the substrate at equal distances from the centerline thereof. A preferred strip applicator device includes means for directing bursts of air or other suitable fluid at the thermoplastic resin film strips 100, 110, 150 and 160 from one or both sides of the substrate to assist in positioning film strips 100, 110, 150 and 160 relative to first fabric section 20. Cutting of the film strip is preferably accomplished using a reciprocating knife blade—blade clamp assembly adapted to intermittently close on and cut film strips 100, 110, 150 and 160, and then open to allow advancement of film. Most preferably, the knife blade assembly includes means for heating the blade for smoother cutting. Simultaneously with the cutting of film strips 100, 110, 150 and 160, a leading edge of the film strips 100, 110, 150 and/or 160 is affixed to first fabric section 20, most preferably using a heat seal bar located such that it contacts the film strip 100, 110, 150 and/or 160 in contact with first fabric section 20.

Figure 4:
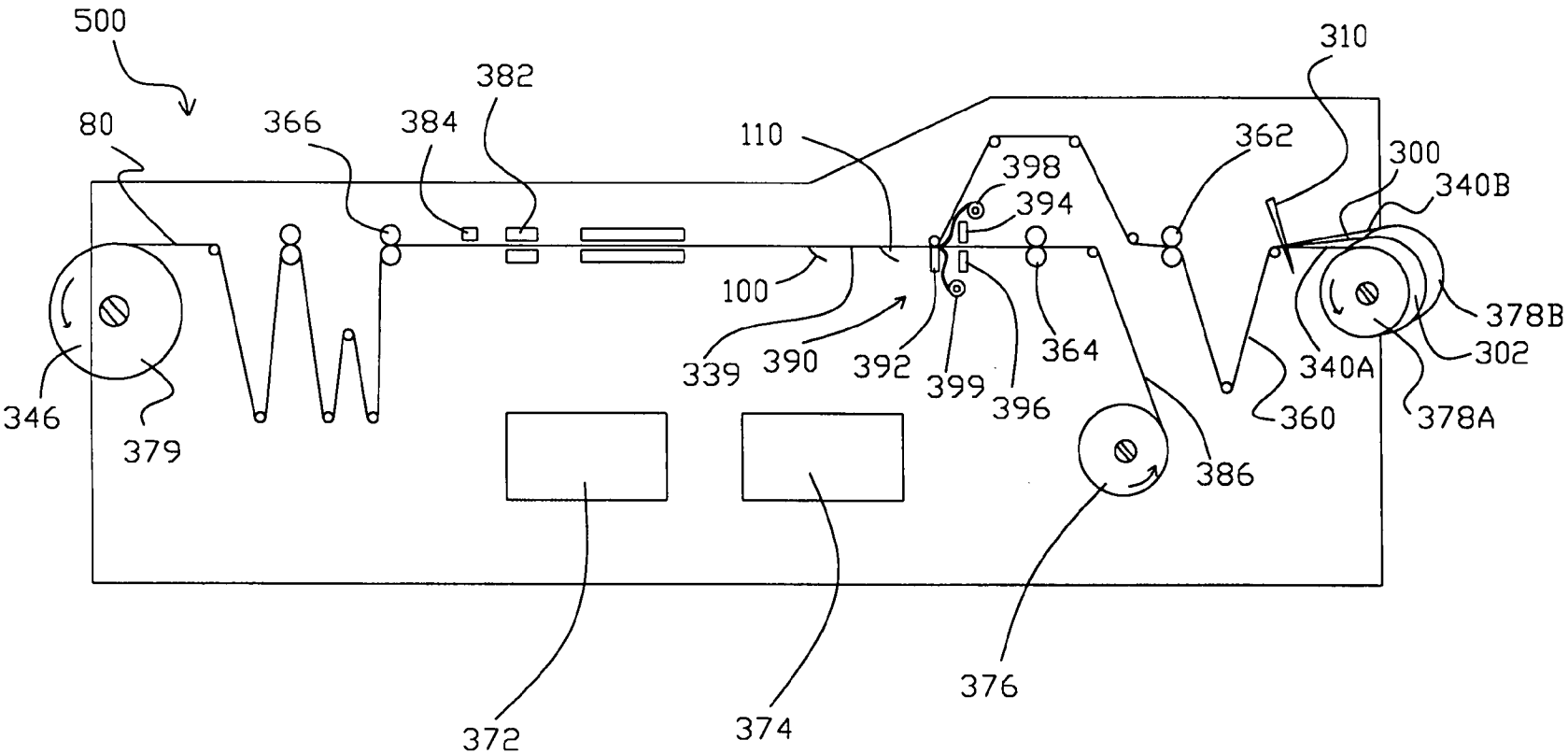
FIG. 4 is a schematic view of an apparatus for producing bag stock for making side-sealed mesh bags having a label section according to a preferred embodiment of the present invention, showing the continuous seal section used to continuously heat seal the fabric from the two fabric rolls to the film from the film roll.

FIGS. 4–8 illustrate a preferred apparatus and method of using the same for manufacture of bag stock from which the invented bags can be formed. Referring now to FIG. 4, a bag-stock-making machine 500 is shown, wherein preferably a stream of film material 300, used to form label section 60 of bag 10, is supplied by a roll 302 of continuous film material 300. Furthermore, preferably two rolls 378A and 378B supply continuous streams of open mesh fabric 340A and 340B, respectively, wherein rolls 378A and 378B and roll 302 are unwound by web drive 362 in a continuous manner, and wherein rolls 378A and 378B preferably flank roll 302 of film material 300. Preferably, streams of open mesh fabric 340A and 340B result in formation of first fabric section 20 and second fabric section 40, respectively, of bag 10. Preferably, stream of film material 300 is continuously heat sealed in the machine direction to streams of open mesh fabric 340A and 340B via heat sealer 310, thus forming bag substrate 360. Although it is preferred that stream of film material 300 and streams of open mesh fabric 340A and 340B be continuously heat sealed via heat sealer 310 prior to advancing through the remainder of the bag-making machinery, it is contemplated in alternate embodiments that stream of film material 300 and streams of open mesh fabric 340A and 340B could be heat sealed in a separate piece of machinery, and thereafter fed into the bag making machinery.

Thermoplastic polymer film 386 in continuous roll form is supplied from roll 376. A predetermined length of film 386 is advanced by servo draw rolls 364. The advancement of streams of open mesh fabric 340A and 340B from rolls 378A and 378B is intermittently interrupted to render the fabric stationary during formation and application of polymer film strip 386 using a strip applicator assembly. Thus, a leading edge of film 386 is tacked, or lightly heat sealed, to the stream of open mesh fabric 340A by tack sealer 392 while the film is simultaneously cut at a predetermined position, corresponding to the width of the affixed sealing strip 100, 110, 150 and/or 160 (only sealing strips 100 and 110 shown), by engaging upper knife clamp 394 with knife assembly 396 to sever film 386. The resulting intermediate bag stock 339, comprising streams of open mesh fabric 340A and 340B heat sealed to stream of film material 300 with sealing strips 100, 110, 150 and/or 160 affixed to stream of open mesh fabric 340A, advances through the apparatus.

Formation of intermediate bag stock 339 and therefore advancement of materials through the apparatus is affected by machine control system 372, wherein machine control system 372 preferably functions to control intermittent stoppage of advancement of the materials at the heat sealing device and thereafter at the strip applicator, as well as resumption of advancement of the materials after the heat sealing device and strip applicator have performed their respective operations on each section or portion of the materials that advance to and through them. Machine control system 372 preferably utilizes a user-friendly touch screen operator interface, digital selection of converting set up parameters, individual job parameter storage and retrieval, with print off of screens for off-line job data storage and diagnostic capabilities. Servo tool drive system 374 in conjunction with machine control system 372 and registration system 384 utilize servo draw rolls 364 and 366 to halt advancement of the intermediate bag stock 339 between servo draw rolls 364 and 366 to allow the cutting and attachment of polymer film strips 100, 110, 150 and/or 160 to stream of open mesh fabric 340A, while at the same time permitting continuous unwinding of rolls 378A, 378B and 302 and continuous winding of roll 379, wherein roll 379 continuously winds the finished bag stock or prepared web 80. Registration system 384 employs a photoelectric cell to detect registration marks or eyemarks 200 on label section 60 in order to move intermediate bag stock 339 the required predetermined distance for attaching the leading edge of polymer film 386 to intermediate bag stock 339 and cutting off polymer film 386 at the predetermined length to form polymer film strips 100, 110, 150, 160 or any other additional film strips. At the same time and at a separate station, polymer film strip 386 is heat sealed with heat sealer 382.

Figure 5:
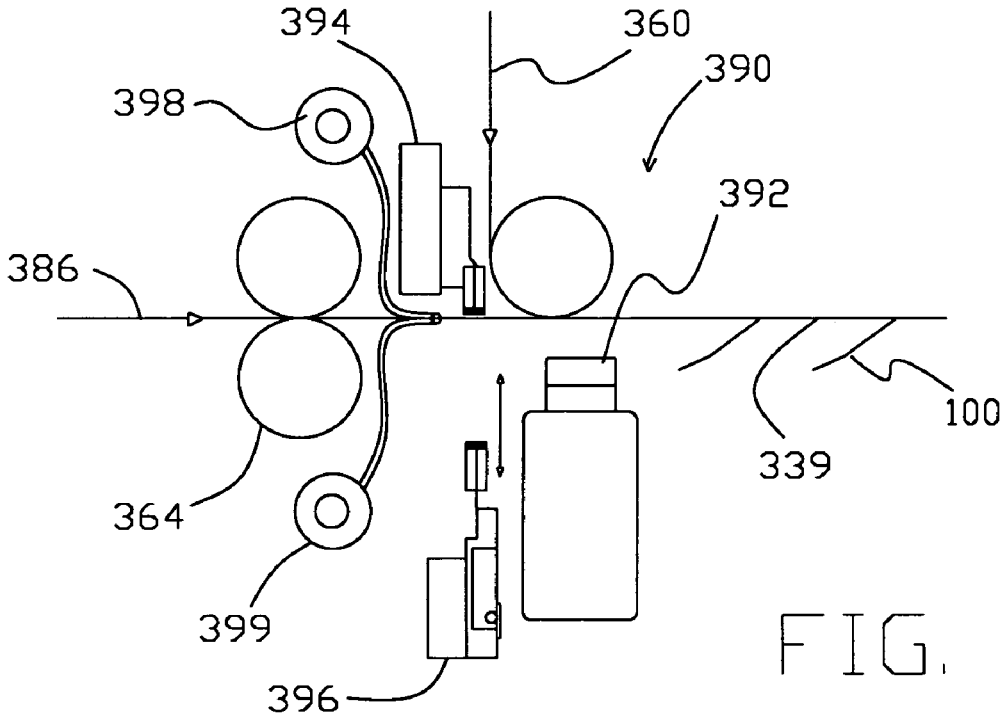
FIG. 5 is a schematic view of the strip applicator system, in feed position, of the apparatus depicted in FIG. 4 for making side-sealed mesh bags having a label section according to a preferred embodiment of the present invention.
Figure 6:
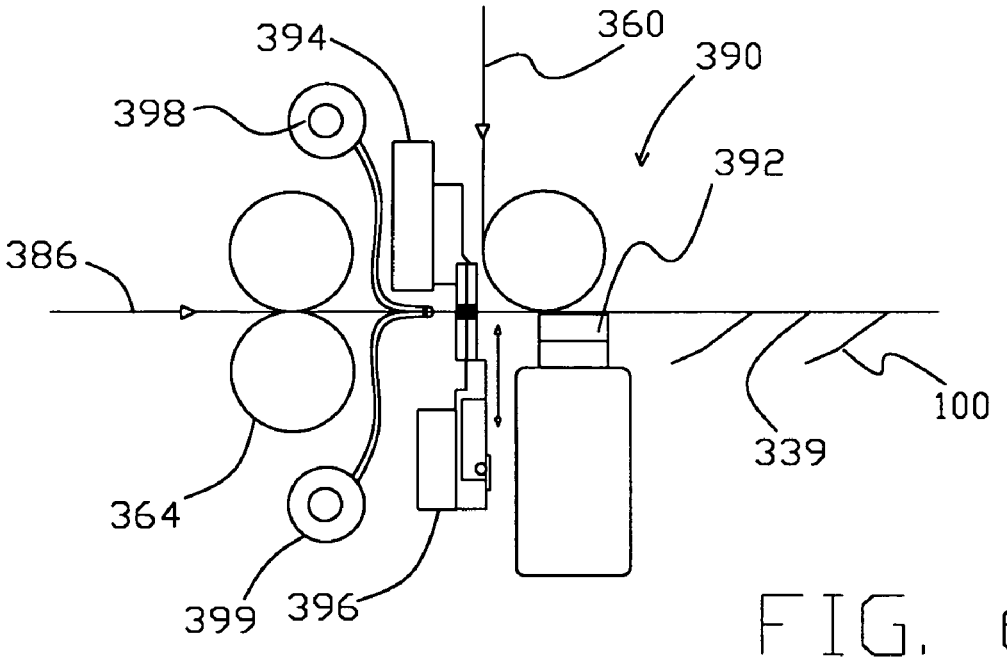
FIG. 6 is a schematic view of the strip applicator system, in the cutoff and strip application position, of the apparatus depicted in FIG. 4 for making side-sealed mesh bags having a label section according to a preferred embodiment of the present invention.

FIGS. 5 and 6 illustrate the strip applicator 390 that functions to produce a continuous intermediate bag stock 339 by cutting a polymer film strip 100 (or film strip 110, 150, 160 or any other additional film strip) and securing it to stream of open mesh fabric 340A of intermediate bag stock 339. A predetermined length of polymer film 386 is fed forward by polymer film strip draw rolls 364. Bursts of air are emitted from upper air stripper 398 and lower air stripper 399 to position polymer film 386 in proper position relative to stream of open mesh fabric 340A of intermediate bag stock 339. Referring to FIG. 6, strip tack sealer 392 is shown in the position to seal the leading edge of polymer film 386 to stream of open mesh fabric 340A of intermediate bag stock 339. At the same time, knife assembly 396 is raised to engage upper knife clamp 394 and thereby sever film 386. Knife assembly 396 and/or tack sealer 392 are movable in the direction of advancement of the fabric and film through the machine so that they can be set to a preselected distance therebetween that corresponds to the length of film 386 to be cut and sealed to stream of open mesh fabric 340A of intermediate bag stock 339 and, ultimately, heat sealed to form a side seam in the bag-making operation. Referring to bag stock 80 illustrated in FIGS. 3 and 8, the distance between knife assembly 396 and tack sealer 392, and in turn the length of cut film 386, correspond to the width—that is, the shorter dimension—of strips 100, 110, 150 and 160 or any additional strips.

Figure 7:
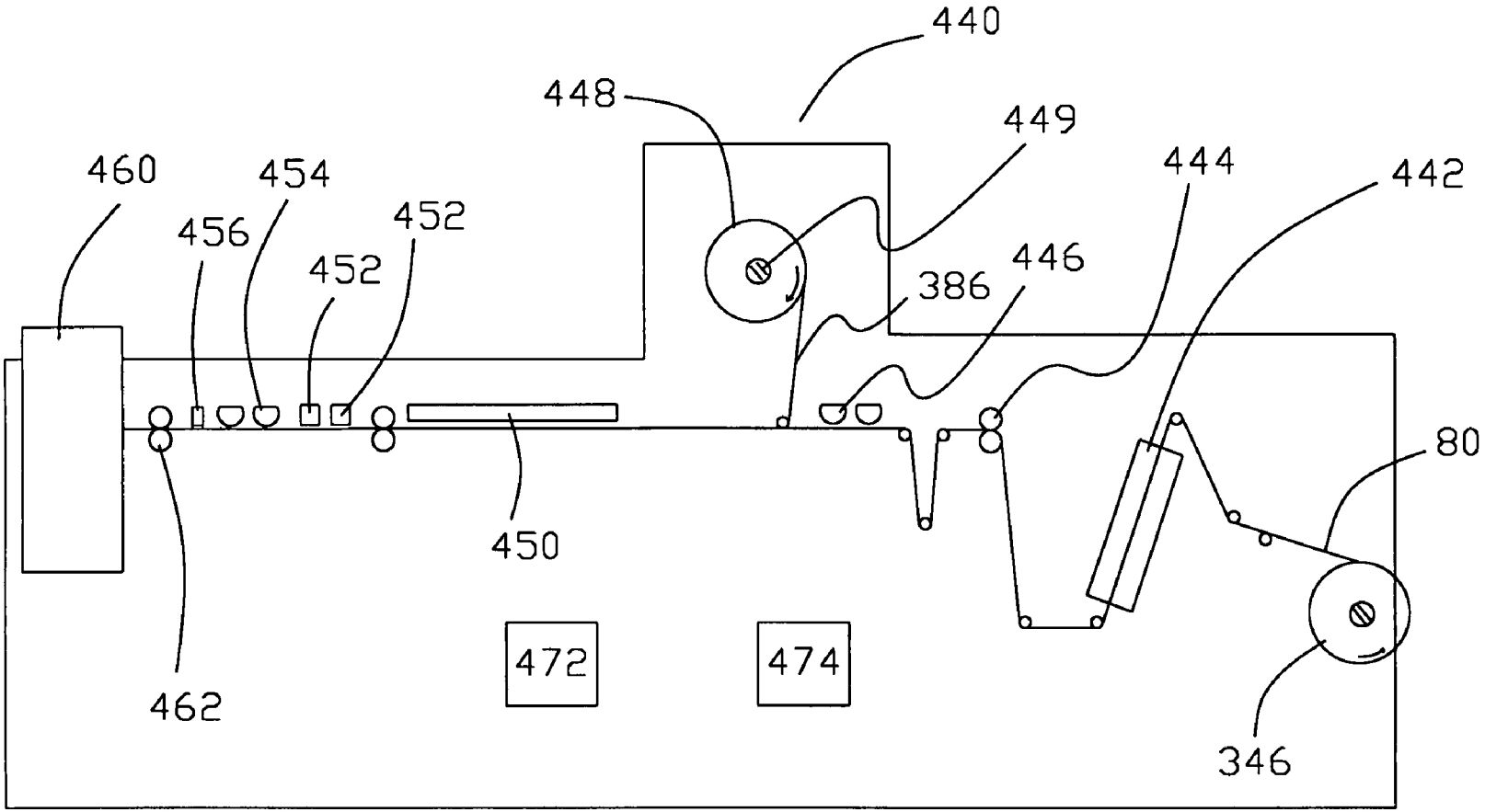
FIG. 7 is a schematic view of an apparatus for converting bag stock into side-sealed mesh bags having a label section according to a preferred embodiment of the present invention.

FIG. 7 illustrates a preferred machine 440 for producing bags 10 from bag stock 80 such as that made as described above. A roll 346 of bag stock 80 with heat sealable film strips is unwound by drive rolls 444 in a continuous manner. Drive rolls 444 draw stock 80 through a folder 442 to fold the stock to a predetermined width. Typically that width is about one half the width of the fabric. For example, for flat top bags the widths of fabric extending from the fold on either side thereof are the same. For other bags, for example those having polymer strips added to provide support for wicketing and/or an area for attachment to filling machines to aid in opening the bags and/or for bags which have a wicket top without polymer film strip reinforcement, the fabric is wider on one side of the fold than on the other. The wider side of the fabric bears the polymer strip for the wicketed top and the narrower side bears the polymer film strip used by produce filling machines to open the formed bag. Optionally, folder 442 can also have a bottom gusset forming attachment.

For bags that are to be punched with wicket holes in the fabric itself, as opposed to in a polymer film strip attached to the fabric, the folded bag stock exiting folder 442 passes between drive rolls 444 to wicket punch 446 which punches holes in the wider side of the fabric extending from the fold. For bags in which wicket holes are to be punched in polymer film attached to the fabric, polymer film is supplied to the folded bag stock from film roll 448, wherein roll 448 is driven by film roll unwinder 449. Polymer film 386 can be slit in the machine or longitudinal direction into two film strips with a slitter (not shown). The film or strips are attached to the top edges of the folded stock 80 with strip sealer 450. Advancement of the folded bag stock is intermittently interrupted for attachment of the polymer strips to the top edges of the stock 80 with strip sealer 450. Simultaneously with heat sealing of the strips to the folded stock, servo draw roll 462 stops the forward movement of the folded stock, cross seams are heat sealed by cross seam sealers 452 and the polymer strip attached to the wider side of the fabric in the previous cycle has a wicket hole formed by wicket punch 454. Machine control system 472 utilizes a user-friendly touch screen operator interface, digital selection of converting set up parameters, individual job parameter storage and retrieval, with print off of screens for off-line job data storage and diagnostic capabilities. Servo tool drive system 474 in conjunction with machine control system 472 and registration system 456 utilize servo draw rolls 462 and 444 to halt advancement of the material between servo draw rolls 462 and 444 to allow the attachment of polymer strips and heat sealing of cross seams by sealer 452. Registration system 456 employs a photoelectric cell to detect registration eye marks 200 on the label section 60 to regulate the distance for moving the folded stock for heat sealing the cross seams with cross-seam sealer 452.

The product of machine 440 is collected using product collection system 460. The product can be collected as a continuous roll without forming individual bags using a windup roll as the collection system. The resulting continuous roll can be cut to form individual bags in a subsequent operation. In another embodiment, individual heat-sealed side seam bags, with either a flat top or wicketed top, are formed on the apparatus. In this embodiment, a draw roll and bag cut-off mechanism are provided including a servo driven draw roll, air assist bag delivery nozzles, static eliminator and a guillotine-style bag cut-off knife. The individual bags are stacked and collected in product collection system 460. If individual heat-sealed side seam bags with a wicketed top are to be formed, an automatic wicket top stacking conveyor, which includes servo driven pickup arms, four-station exposed wicket stacking conveyor and pin designed for wicket wire removal, can be provided. In this embodiment bags are provided in the form of a stack made up of a plurality of bags disposed on a wicket. As described above, the wicket generally is in the form of a wire or rod having two right angle bends and adapted to receive and hold in place the bags by means of holes in an end of the bags.

The invented bags are well suited as produce bags for packaging, transportation, storage and display of agricultural products such as potatoes, onions, apples, oranges, etc. They also can be used for toys, games, blocks, sporting goods and other solid articles as well as canned and bottled liquid and semi-solid products, e.g., multi-count packs of canned foods, bottled beverages and the like.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A method of high-speed bag manufacturing, comprising the step of:

a. bringing into contact an edge of at least one first open thermoplastic fabric section, and an edge of at least one second open thermoplastic fabric sheet with at least one film section to form a prepared sheet, said at least one film section selected from the group consisting of polyolefin films, and films sealable to open thermoplastic fabric, wherein said prepared sheet is V-folded along a central axis to form a closed butt end, and wherein opposing overlapping edges of said prepared sheet are sealed via a thermoplastic sealing strip to form a bag having at least one opening.

2. The method of claim 1, wherein said edge of said at least one first open thermoplastic fabric sheet and said edge of said at least one second open thermoplastic fabric sheet are heat sealed to opposing edges of said at least one film section.

3. The method of claim 1, wherein said at least one first open thermoplastic fabric sheet comprises a width at least equal to a combined width of said at least one film section and said at least one second open thermoplastic fabric sheet, such that said central axis is disposed on said at least one first open thermoplastic fabric sheet.

4. The method of claim 1, wherein said at least one first open thermoplastic fabric sheet and said at least one second open thermoplastic fabric sheet are cross-laminated thermoplastic nonwoven net-like fabric.

5. The method of claim 1, wherein said at least one film section is a polymeric film capable of receiving print thereon to permit said at least one film section to serve as a label section for said bag.

6. The method of claim 1, wherein said opposing overlapping edges of said prepared sheet are sealed via a first said thermoplastic sealing strip and a second said thermoplastic sealing strip.

7. The method of claim 6, wherein said first thermoplastic sealing strip and said second thermoplastic sealing strip are carried by opposing edges of said at least one first open thermoplastic fabric sheet, extending perpendicularly from said central axis through a remaining width of said at least one first open thermoplastic fabric sheet.

8. The method of claim 7, wherein V-folding of said prepared sheet along said central axis results in said first thermoplastic sealing strip and said second thermoplastic sealing strip sealing said opposing overlapping edges of said prepared sheet upon application of heat and pressure thereto.

9. A method of high-speed bag manufacturing, comprising the steps of:

a. bringing into contact an edge of at least one first open thermoplastic fabric sheet, and an edge of at least one second open thermoplastic fabric section with at least one film section to form a prepared sheet, said at least one film section selected from the group consisting of polyolefin films, and films sealable to open thermoplastic fabric, wherein said prepared sheet is V-folded along a central axis to form a closed butt end, and wherein opposing overlapping edges of said prepared sheet are sealed to form a bag having at least one opening; and b. sealing said opposing overlapping edges of said prepared sheet via a sealing means, said sealing means comprising a first thermoplastic sealing strip and a second thermoplastic sealing strip.

10. The method of claim 9, wherein said edge of said at least one first open thermoplastic fabric sheet and said edge of said at least one second open thermoplastic fabric sheet are heat sealed to opposing edges of said at least one film section.

11. The method of claim 9, wherein said at least one first open thermoplastic fabric sheet comprises a width at least equal to a combined width of said at least one film section and said at least one second open thermoplastic fabric sheet, such that said central axis is disposed on said at least one first open thermoplastic fabric sheet.

12. The method of claim 9, wherein said at least one first open thermoplastic fabric sheet and said at least one second open thermoplastic fabric sheet are a cross-laminated thermoplastic nonwoven net-like fabric.

13. The method of claim 9, wherein said at least one film section is a polymeric film capable of receiving print thereon to permit said at least one film section to serve as a label section for said bag.

14. The method of claim 9, wherein said first thermoplastic sealing strip and said second thermoplastic sealing strip are carried by opposing edges of said at least one first open thermoplastic fabric sheet, extending perpendicularly from said central axis through a remaining width of said at least one first open thermoplastic fabric sheet.

15. The method of claim 14, wherein V-folding of said prepared sheet along said central axis results in said first thermoplastic sealing strip and said second thermoplastic sealing strip sealing said opposing overlapping edges of said prepared sheet upon application of heat and pressure thereto.

16. A method of high-speed bag manufacturing, comprising the steps of:

a. bringing into contact an edge of at least one first open thermoplastic fabric sheet, and an edge of at least one second open thermoplastic fabric sheet with at least one film section to form a prepared sheet, said at least one film section selected from the group consisting of polyolefin films, and films sealable to open thermoplastic fabric, wherein said at least one first open thermoplastic fabric sheet comprises a width at least equal to a combined width of said at least one film section and said at least one second open thermoplastic fabric section such that a central axis is disposed on said at least one first open thermoplastic fabric section, and wherein said prepared sheet is V-folded along said central axis to form a closed, butt end, and wherein opposing overlapping edges of said prepared sheet are sealed via a thermoplastic sealing strip to form a bag having at least one opening.

17. The method of claim 16, wherein said edge of at least one first open thermoplastic fabric sheet and said edge of said at least one second open thermoplastic fabric sheet are heat sealed to opposing edges of said at least one film section.

18. The method of claim 16, wherein said at least one first open thermoplastic fabric sheet and said at least one second thermoplastic fabric sheet are a cross-laminated thermoplastic nonwoven net-like fabric.

19. The method of claim 16, wherein said at least one film section is a polymeric film capable of receiving print thereon to permit said at least one film section to serve as a label section for said bag.

20. The method of claim 16, wherein said opposing overlapping edges of said prepared sheet are sealed via a first said thermoplastic sealing strip and a second said thermoplastic sealing strip.

21. The method of claim 20, wherein said first thermoplastic sealing strip and said second thermoplastic sealing strip are carried by opposing edges of said at least one first open thermoplastic fabric sheet, extending perpendicularly from said central axis through a remaining width of said at least one first open thermoplastic fabric sheet.

22. The method of claim 21, wherein V-folding of said prepared sheet along said central axis results in said first thermoplastic sealing strip and said second thermoplastic sealing strip sealing said opposing overlapping edges of said prepared sheet upon application of heat and pressure thereto.

23. A method of high-speed bag manufacturing, comprising the steps of:

a. bringing into contact an edge of at least one first continuous stream of open thermoplastic fabric, and an edge of at least one second continuous stream of open thermoplastic fabric with at least one continuous stream of film to form a bag stock, said at least one continuous stream of film selected from the group consisting of polyolefin films, and films sealable to open thermoplastic fabric, wherein said bag stock is V-folded along a longitudinally disposed central axis to form a continuous, closed butt end, and wherein said bag stock is transversely sealed via a plurality of thermoplastic sealing strips, and cut, at pre-selected distances to form bags having at least one opening.

24. The method of claim 23, wherein said edge of said at least one first continuous stream of open thermoplastic fabric and said edge of said at least one second continuous stream of open thermoplastic fabric are heat sealed to opposing edges of said at least one continuous stream of film.

25. The method of claim 23, wherein said at least one first continuous stream of open thermoplastic fabric comprises a width at least equal to a combined width of said at least one continuous stream of film and said at least one second continuous stream of open thermoplastic fabric, such that said central axis is disposed on said at least one first continuous stream of open thermoplastic fabric.

26. The method of claim 23, wherein said at least one first continuous stream of open thermoplastic fabric and said at least one second continuous stream of open thermoplastic fabric are a cross-laminated thermoplastic nonwoven net-like fabric.

27. The method of claim 23, wherein said at least one continuous stream of film is polymeric film capable of receiving print thereon to permit said at least one continuous stream of film to serve as a label section for said bag.

28. The method of claim 23, wherein said plurality of thermoplastic sealing strips are carried by and transversely positioned at regular intervals along a longitudinal direction of said at least one first continuous stream of open thermoplastic fabric, extending perpendicularly from said central axis through a remaining width of said at least one first continuous stream of open thermoplastic fabric, such that said bags cut from said bag stock each comprise at least one first thermoplastic sealing strip and at least one second thermoplastic sealing strip positioned at opposite edges thereof.

29. The method of claim 28, wherein application of heat and pressure to V-folded said bag stock results in said plurality of thermoplastic sealing strips being transversely sealed across V-folded said bag stock.

30. The method of claim 28, wherein each thermoplastic sealing strip of said plurality of thermoplastic sealing strips comprise a width at least equal to a combined width of said at least one first thermoplastic sealing strip and said at least one second thermoplastic sealing strip such that transverse cutting of said bag stock along each said thermoplastic sealing strip of said plurality of thermoplastic sealing strips yields said at least one first thermoplastic sealing strip for a first cut said bag, and said at least one second thermoplastic sealing strip for a second cut said bag.

31. A method of high-speed bag manufacturing, comprising the steps of:

a. bringing into contact an edge of at least one first continuous stream of open thermoplastic fabric, and an edge of at least one second continuous stream of open thermoplastic fabric with at least one continuous stream of film to form a bag stock, said at least one continuous stream of film selected from the group consisting of polyolefin films, and films sealable to open thermoplastic fabric, wherein said bag stock is V-folded along a longitudinally disposed central axis to form a continuous, closed butt end, and wherein said bag stock is transversely sealed and cut, at pre-selected distances to form bags having at least one opening; and b. sealing V-folded said bag stock at said pre-selected distances via a sealing means, said sealing means comprising a plurality of thermoplastic sealing strips, wherein said bags cut from said bag stock each comprise a first thermoplastic sealing strip and a second thermoplastic sealing strip positioned opposite edges thereof.

32. The method of claim 31, wherein said edge of said at least one first continuous stream of open thermoplastic fabric and said edge of said at least one second continuous stream of open thermoplastic fabric are heat sealed to opposing edges of said at least one continuous stream of film.

33. The method of claim 23, wherein said at least one first continuous stream of open thermoplastic fabric comprises a width at least equal to a combined width of said at least one continuous stream of film and said at least one second continuous stream of open thermoplastic fabric, such that said central axis is disposed on said at least one first continuous stream of open thermoplastic fabric.

34. The method of claim 31, wherein said at least one first continuous stream of open thermoplastic fabric and said at least one second continuous stream of open thermoplastic fabric are a cross-laminated thermoplastic nonwoven net-like fabric.

35. The method of claim 31, wherein said at least one continuous stream of film is polymeric film capable of receiving print thereon to permit said at least one continuous stream of film to serve as a label section for said bag.

36. The method of claim 31, wherein said plurality of thermoplastic sealing strips are carried by and transversely positioned at regular intervals along a longitudinal direction of said at least one first continuous stream of open thermoplastic fabric, extending perpendicularly from said central axis through a remaining width of said at least one first continuous stream of open thermoplastic fabric.

37. The method of claim 36, wherein application of heat and pressure to V-folded said bag stock results in said plurality of thermoplastic sealing strips being transversely sealed across V-folded said bag stock.

38. The method of claim 36, wherein each thermoplastic sealing strip of said plurality of thermoplastic sealing strips comprise a width at least equal to a combined width of said at first thermoplastic sealing strip and said second thermoplastic sealing strip such that transverse cutting of said bag stock along each said thermoplastic sealing strip of said plurality of thermoplastic sealing strips yields said first thermoplastic sealing strip for a first cut said bag, and said second thermoplastic sealing strip for a second cut said bag.

39. A method of high-speed bag manufacturing, comprising the steps of:

a. bringing into contact an edge of at least one first continuous stream of open thermoplastic fabric, and an edge of at least one second continuous stream of open thermoplastic fabric with at least one continuous stream of film to form a bag stock, said at least one continuous stream of film selected from the group consisting of polyolefin films, and films sealable to open thermoplastic fabric, wherein said at least one first continuous stream of open thermoplastic fabric compirses a width at least equal to a combined width of said at least one continuous stream of film and said at least one second continuous stream of open thermoplastic fabric such that a central axis is longitudinally disposed on said at least one first continuous stream of open thermoplastic fabric, and wherein said bag stock is V-folded along said central axis to form a continuous, closed butt end, and wherein said bag stock is transversely sealed via a plurality of thermoplastic sealing strips, and cut, at pre-selected distances to form bags having at least one opening.

40. The method of claim 39, wherein at least one edge of said at least one first continuous stream of the open thermoplastic fabric and at least one edge of said at least one second continuous stream of open thermoplastic fabric are heat sealed to opposing edges of said at least one continuous stream of film.

41. The method of claim 39, wherein said at least one first continuous stream of open thermoplastic fabric and said at least one second continuous stream of open thermoplastic fabric are a cross-laminated thermoplastic nonwoven net-like fabric.

42. The method of claim 39, wherein said at least one continuous stream of film is a polymeric film capable of receiving print thereon to permit said at least one continuous stream of film to serve as a label section for said bag.

43. The method of claim 39, wherein said plurality of thermoplastic sealing strips are carried by and transversely positioned at regular intervals along a longitudinal direction of said at least one first continuous stream of open thermoplastic fabric, extending perpendicularly from said central axis through a remaining width of said at least one first continuous stream of open thermoplastic fabric, such that said bags cut from said bag stock each comprise at least one first thermoplastic sealing strip and at least one second thermoplastic sealing strip positioned at opposite edges thereof.

44. The method of claim 43, wherein application of heat and pressure to V-folded said bag stock results in said plurality of thermoplastic sealing strips being transversely sealed across V-folded said bag stock.

45. The method of claim 43, wherein each thermoplastic sealing strip of said plurality of thermoplastic sealing strips comprise a width at least equal to a combined width of said at least one first thermoplastic sealing strip and said at least one second thermoplastic sealing strip such that transverse cutting of said bag stock along each said thermoplastic sealing strip of said plurality of thermoplastic sealing strips yields said at least one first thermoplastic sealing strip for a first cut said bag, and said at least one second thermoplastic sealing strip for a second cut said bag.

* * * * *